US006994943B2

(12) United States Patent
Tanma et al.

(10) Patent No.: US 6,994,943 B2
(45) Date of Patent: Feb. 7, 2006

(54) TONER FOR DEVELOPING STATIC LATENT IMAGE, PRODUCING METHOD THEREOF AND IMAGE FORMING METHOD

(75) Inventors: Tomoko Tanma, Hino (JP); Asao Matsushima, Hino (JP); Hiroyuki Kozuru, Hino (JP); Tomoe Kitani, Hino (JP)

(73) Assignee: Konica Corporation, (JP)

( * ) Notice: Subject to any disclaimer, the term of this patent is extended or adjusted under 35 U.S.C. 154(b) by 159 days.

(21) Appl. No.: 10/434,962

(22) Filed: May 9, 2003

(65) Prior Publication Data

US 2003/0219671 A1 Nov. 27, 2003

(30) Foreign Application Priority Data

May 15, 2002 (JP) ..... 2002-140104

(51) Int. Cl.
*G03G 9/08* (2006.01)

(52) U.S. Cl. ..... 430/110.2; 430/108.1; 430/126; 430/137.1

(58) Field of Classification Search ..... 430/110.4, 430/108.1, 137.1, 126
See application file for complete search history.

(56) References Cited

U.S. PATENT DOCUMENTS 5,912,101 A * 6/1999 Karaki et al. ..... 430/108.8
6,124,070 A * 9/2000 Baba et al. ..... 430/109.3
6,171,747 B1 * 1/2001 Sugizaki et al. ..... 430/126

* cited by examiner

*Primary Examiner*—John L Goodrow
(74) *Attorney, Agent, or Firm*—Squire, Sanders & Dempsey L.L.P.

(57) ABSTRACT

A toner for developing a static latent image is disclosed. The toner has a number based particle diameter distribution curve in which peak or maximum value is within the range of from 1.0 to 2.0 $\mu$m, and ratio of particles having particle diameter of from 1.0 to 2.0 $\mu$m is from 0.1 to 5.0% and ratio of particle having a diameter of at least 6.35 $\mu$m is 5.0%.

20 Claims, 1 Drawing Sheet

TONER FOR DEVELOPING STATIC LATENT IMAGE, PRODUCING METHOD THEREOF AND IMAGE FORMING METHOD

FIELD OF THE INVENTION

The invention relates to a toner for developing a static latent image, hereinafter also simply referred to as toner, a producing method thereof and an image forming method using the toner.

BACKGROUND OF THE INVENTION

Recently, a static latent image developing method is mostly applied in an image forming apparatus for rapidly forming a high quality image. One of the important themes in this field is further improvement of the image quality. Many technological developments have been carried to the present time.

The most effective means for improving image quality is to reduce the diameter of the toner particles. The improvement in image quality has progressed by the use of toner particles having a smaller diameter and narrower distribution range than usual toner for the reason mentioned later.

For example, toner having a number average particle diameter of from 3.0 to 6.5 μm has recently been employed, although a toner having a number average diameter of from 9 to 11 μm has usually been used though the objective of the toner is to form high quality images.

In such cases, roughing of image is caused by the presence of coarse particles and scattering of the extremely fine particles are occurs when distribution of the toner particle diameter is broad. Consequently, efforts have been made to make the diameter uniform and the appearance of the toner particles since such the phenomena causes the degradation of image quality and environmental problems.

SUMMARY OF THE INVENTION

The image quality has been considerably improved by such the efforts. The main technical means for improving the image quality is to make small the diameter and to make even the diameter and the shape of the toner particles. However, according to the investigation by the inventors, the problems are not completely solved.

Particularly, the problem of the transferring ratio in the transfer process in which a toner image formed on the static latent image carrying member is transferred onto a image receiving material such as image receiving paper, and the tendency of insufficient cleaning in the process for cleaning the toner remaining on the latent image carrying member still remains, and the problems of uniformity of halftone images and reproducibility of fine line images are also not yet sufficiently solved. The latent image carrying member is usually an electrophotographic photoreceptor, hereinafter also simply referred to as photoreceptor.

An objective of this invention is to provide a fine particle toner for developing a static latent image by which a high quality image can be obtained with a high transferring ratio, high halftone uniformity and high fine line reproducibility without occurrence of insufficient cleaning, and to provide a production method for the toner and an image forming method.

It has been assumed that the fine particles having a diameter of not more than 2.0 μm are preferably not contained in the particle diameter distribution of toner, from the viewpoint of contamination of the image forming apparatus by the toner particles.

However, according to investigations by the inventors, it was found that the transfer of the toner onto the image receiving material, and the cleaning ability of the toner on the photoreceptor improve by the presence of fine particles having a number average particle diameter of from 1.0 to 2.0 μm, hereinafter also referred to as fine particle toner, and having the same composition as the other particles contained in the toner. In addition, it was found that the content of particles having a diameter of at least 6.35 μm, which is included on the coarse end of the particle diameter distribution, is preferably small from the viewpoint of the halftone uniformity and reproducibility of fine lines.

The invention and its preferable embodiment are described.

Toner for developing a static latent image having a number based particle diameter distribution curve in which peak or the maximum value is within the range of from 1.0 to 2.0 μm, and the ratio of the particles having particle diameter of from 1.0 to 2.0 μm is from 0.1 to 5.0% and the ratio of the particle having a diameter of at least 6.35 μm is 5.0%.

The number average diameter of the toner particles is preferably from 3.0 to 6.0 μm.

The toner may contain inorganic particles having primary diameter of 10 to 300 nm, however it is not preferable to contain inorganic particles having primary diameter of 1 μm or more.

DETAILED DESCRIPTION OF THE INVENTION

The reason that the effects of the invention can be obtained is assumed to be as follows, even though the reason for the effects is not particularly clear.

When composition of fine toner particles is the same as that of the toner particles forming the image, the polarities of the charge on each of the toner particles are the same, and adhesion of the particles by static electricity does not occur, whereby, the transferring and cleaning ability can function more effectively. When composition of the fine toner particles is different from that of the toner particles forming the image, the fine toner particles adhere onto the toner particle forming the image since these kinds of particles each have different charging polarity from each other. Consequently, fine toner particles cannot be remained on the photoreceptor and the foregoing effects do not appear.

In this invention, the content ratio of the toner particles having a diameter of from 1.0 to 2.0 μm is from 0.1 to 5.0%, preferably from 0.3 to 2.0 μm in number to the whole number of the toner particles.

The fine toner particles having a diameter of from 1.0 to 2.0 μm may be constituted only of resin, and may further contain a colorant, a charge controlling agent or a mold releasing agent. In the chemical structure, one or both of the binder resins and the colorant contained in the fine toner particles is preferably the same as those contained in the larger toner particles. When charge controlling agents or the mold releasing agents are contained, the chemical structure of the fine toner particles is preferably the same as that contained in the larger toner particles. It is particularly preferable that the polarity of the charge of the fine toner particles and that of the larger toner particles is similar.

The definition of "the particle diameter distribution has a peak or the maximum value between 1.0 to 2.0 μm" means that a portion clearly higher than the neighborhood is in the region of the particle diameter distribution curve. The portion higher than the neighborhood includes not only a portion having a sharp-pointed spectrum but also a gently-sloping portion higher than the neighborhood. It is accepted that the top of the peak or the maximum value is within the region of from 1.0 to 2.0 μm.

Figure 1:
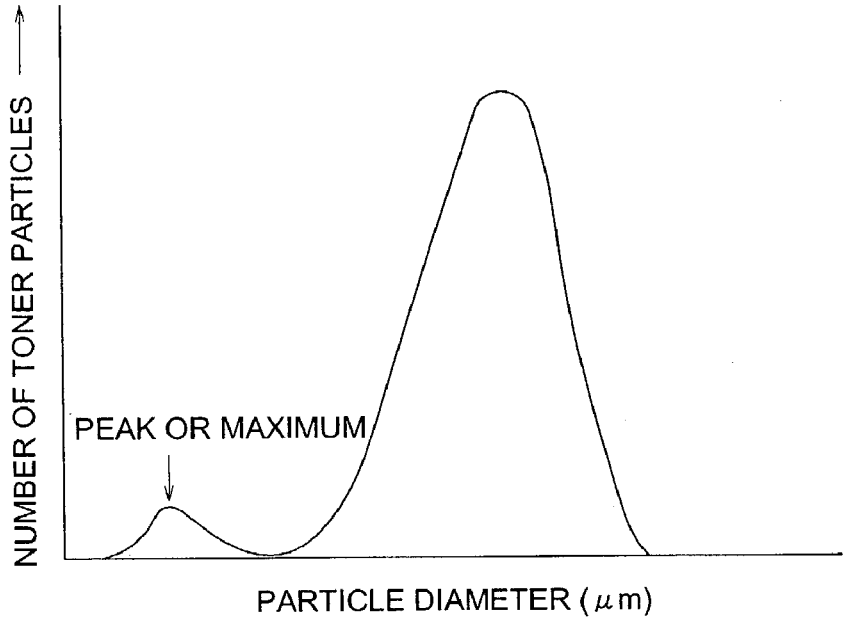
FIG. 1 shows a schematic view of toner particle distribution.

In the usual particle diameter distribution curve, the highest portion is near the average particle diameter or the central region of the distribution and the distribution is lowered based on the distance from the highest portion. However, the particle diameter distribution curve of the toner according to this invention clearly has a peak or maximum value in the region from 1.0 to 2.0 μm. FIG. 1 schematically shows the particle diameter distribution curve.

At the larger size end of the particle diameter distribution curve of the toner, the ratio of particles of not less than 6.35 μm is not more than 5%. The ratio is preferably from 0 to 2.0%, more preferably from 0 to 1.0% for obtaining suitable uniformity of halftone and fine line reproducibility. The diameter of the toner is preferably small for obtaining the high quality images. Concretely, the number average diameter of the toner is preferably from 3.0 to 6.0 μm, and more preferably from 3.0 to 5.0 μm. Drawbacks on image quality and the environment caused by scattering of the toner can be inhibited, and suitable image quality or high resolution as well as sharpness can be obtained by such a toner.

In an example of a method for obtaining toner having the peak or the maximum value in the region of from 1.0 to 2.0 μm of the particle diameter distribution thereof, the small diameter toner particles, each having a diameter of from 1.0 to 2.0 μm are mixed with the usual toner particles each having a diameter larger than the small toner particles. In another example, the following means are applied; the time of addition of a salting agent is advanced, the amount of the salting agent is reduced, the temperature is lowered after the addition of the salting agent and a combination of such means, in the course of coagulation or fusion-adhering of extremely fine resin particles with a diameter about 100 nm are salted out. On the occasion of shell-making after coagulation and fusion-adhering of the extremely fine resin particles by addition of fine resin particles, the particle diameter distribution can be controlled by the amount of the fine resin particles, the temperature at and after the shell-making, the period of addition and the amount of a stopping agent, or a combination of such the means. These processes are performed under monitoring and can be stopped by lowering the temperature or changing the pH value at the step at which the designated value can be attained.

The number average particle diameter and particle distribution curve are measured by employing a sheath flow electric resistance meter SD-2000, manufactured by Sysmex Corporation, in the following condition.

Measuring Condition

Measuring Mode: Peak Count Mode
Measuring Range: 50 μm Orifice
Measuring Volume: 17 μL
Number of Counts: Around 50,000
Repeating cycle: 0

An average diameter of toner particles does not vary by adding an external additive usually employed. Therefore, the average particle diameter or shape of the toner particles before or after addition of the external additive are described in the same way. Toner particles without an external additive may be called as "colored particle" this specification.

A preparation method of toner and an image forming method are described.

(1) Preparation of Toner

1. Preparation of Toner Particles

Toner particles suitably employed invention may be prepared in any way. However it is preferred to employ so called polymerization method, which does not comply pulverization or classification process. Practically it is difficult to prepare toner particles having controlled small particles according to this invention by pulverization method.

A polymerization method is employed to obtain the toner particles suitable for this invention. An example is a suspension polymerization, and the other is a method, wherein preparing minute resin particles by polymerizing monomers by emulsion polymerization or mini-emulsion polymerization, an emulsified material being added during these process, and thereafter, the obtained minute particles are coagulated and fused to form toner particles by adding a coagulant such as an organic solvent or salt.

Further, a liquid polymerization method disclosed in JA 7-287419A or a liquid dispersion suspension method disclosed in JA 11-15191A may be employed.

(1) Suspension Polymerization Method

One example of the method for producing the toner of the present invention is as follows. Various types of components such as colorants, and if desired, release agents, and polymerization initiators are added into polymerizable monomers, and subsequently, the various types of components are dissolved in or dispersed into the polymerizable monomers, employing a homogenizer, a sand mill, a sand grinder, or an ultrasonic homogenizer. The resulting monomers, which comprise dissolved or dispersed components, are dispersed into a water-based medium, employing a homomixer or a homogenizer to form oil droplets, having the specified size as toner particles.

Thereafter, the resulting dispersion is placed in a reaction apparatus (i.e., a stirring apparatus), which is fitted with stirring mechanisms, which refer to the stirring blade described below, and undergoes reaction while being heated. As a result, fine resinous particles are prepared. Subsequently, the aforesaid coagulants such as salts are added and the resinous particles are aggregated and fused. Thereafter, the resulting toner particles are separated, washed, the impurities in the toner particles are removed, and dried, whereby the toner of the present invention is prepared. Incidentally, as used herein, the term "water-based medium" is used to refer to a medium which is comprised of at least 50 percent of water by weight.

(2) Emulsion Polymerization Method

Further, listed as a method for producing the toner of the present invention may be a method in which resinous particles are prepared employing an emulsion polymerization method and the resulting particles are aggregated and fused. There is no limitation for the method. However, listed as methods may be those described, for example, in Japanese Patent Application Open to Public Inspection Nos. 5-265252, 6-329947, and 9-15904.

Thereafter, as previously described, resinous particles and constituting materials, such as colorants, are aggregated and fused, and subsequently, heated to a temperature higher or equal to the glass transition point so as to be fused. The preferable processes are as follows. The resulting particles are dispersed in water, employing emulsifiers. Thereafter, the resulting dispersion is salted out by adding coagulants in an amount of at least the critical aggregation concentration. The resulting polymer is heated to higher or equal to the glass transition temperature, and preferably, the particle size is allowed to gradually increase. When the particle size reaches the specified value, the aforesaid aggregation terminating agents are added to terminate an increase in particle size. Further, during heating and stirring, the particle surface is smoothed and the particle shape is controlled. Subsequently, the resulting particles are separated from the dispersion and heat dried, whereby it is possible to form the toner of the present invention. Incidentally, herein, in order to efficiently proceed with fusion, solvents such as alcohols, which are infinitely soluble in water, may be simultaneously added.

(3) Composite Resin Particles by Multi-Step Polymerization

An example of composite resin particles prepared by a multi-step polymerization method, which is a representative preparation method of toner by an emulsion polymerization. A area other than the outermost layer of the composite resin particle preferably contains a releasing agent.

The production process comprises mainly, for example, the following processes:

1. A multi-step polymerizing process to obtain composite resin particles comprising core, inter layer and an outermost layer. In case of the composite resin particles contains a releasing agent, it is preferable to contain in other than an outer layer.
2. A salting-out/coagulation process to produce a toner particle by salting-out/coagulating the composite resin particles and colored particles.
3. Filtering and washing processes to filter the toner particles from the toner particle dispersion and to remove an unnecessary substance such as the surfactant from the toner particles.
4. A drying process to dry the washed toner particles.
5. A process to add an exterior additive to the toner particles.

Each of the processes is described more in detail below.

(Multi-Step Polymerization Process)

The multi-step polymerization process is a process for preparing the composite resin particle having covering layer of polymer on a resin particle.

It is preferred from the viewpoint of the stability and the anti-crush strength of the obtained toner to apply the multi-step polymerization including three or more polymerization steps.

The two- and tree-step polymerization methods, which are representative examples, are described below.

(Two-Step Polymerization Method)

The two-step polymerization method is a method for producing the composite resin particle comprised of the central portion (core) containing the crystalline material comprising the high molecular weight resin and an outer layer (shell) comprising the low molecular weight resin.

Practically a monomer liquid is prepared by incorporating the crystalline material in a monomer, the monomer liquid is dispersed in an aqueous medium (an aqueous solution of a surfactant) in a form of oil drop, and the system is subjected to a polymerization treatment (the first polymerization step) to prepare a dispersion of a higher molecular weight resin particles each containing the crystalline material.

Next, a polymerization initiator and a monomer to form the lower molecular weight resin is added to the suspension of the resin articles, and the monomer L is subjected to a polymerization treatment (the second polymerization step) to form a covering layer composed of the lower molecular weight resin (a polymer of the monomer) onto the resin particle.

(Three-Step Polymerization Method)

The three-step polymerization method is a method for producing the composite resin particle comprised of the central portion (core) comprising the high molecular weight resin, the inter layer containing the crystalline material and the outer layer (shell) comprising the low molecular weight resin.

Practically a suspension of the resin particles prepared by the polymerization treatment (the first polymerization step) according to a usual procedure is added to an aqueous medium (an aqueous solution of a surfactant) and a monomer liquid prepared by incorporating the crystalline material in a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

In the three-step polymerization method, the releasing agent can be finely and uniformly dispersed by applying a procedure, at the time of forming the inter layer on the resin particle.

The polymer is preferably obtained by polymerization in the aqueous medium. The crystalline material is incorporated in a monomer, and the obtained monomer liquid is dispersed in the aqueous medium as oil drop at the time of forming resin particles (core) or covering layer thereon (inter layer) containing the crystalline material, and resin particles containing a releasing agent can be obtained as latex particles by polymerization treatment with the addition of initiator.

The water based medium means one in which from 50 to 100 percent by weight of water, is incorporated. Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. The monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, CLEARMIX, ultrasonic homogenizers, mechanical homogenizers, and Manton-Gaulin homogenizers and pressure type homogenizers. The diameter of dispersed particles is 10 to 1,000 nm, and is preferably 30 to 300 nm.

Emulsion polymerization, suspension polymerization seed emulsion etc. may be employed as the polymerization method to form resin particles or covered layer containing the crystalline material. These polymerization methods are also applied to forming resin particles (core particles) or covered layer which do not contain the crystalline material.

The particle diameter of composite particles obtained by the process (1) is preferably from 10 to 1,000 nm in terms of weight average diameter determined employing an electrophoresis light scattering photometer ELS-800· (produced by OTSUKA ELECTRONICS CO., LTD.).

Glass transition temperature (Tg) of the composite resin particles is preferably from 48 to 74° C., and more preferably from 52 to 64° C.

The Softening point of the composite resin particles is preferably from 95 to 140° C.

Salting-Out/Fusion Process

Salting-out/fusion process is a process to obtain toner particles having undefined shape (aspherical shape) in which the composite resin particles obtained by the foregoing process and colored particles are aggregated.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resin particles and colored particles) must be subjected to coagulation in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. Surface of the colored particles may be modified by a surface modifier.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Homogenizers employed in the dispersion of the colored particles include, for example, CLEARMIX, ultrasonic homogenizers, mechanical homogenizers, and Manton-Gaulin homogenizers and pressure type homogenizers.

In order to simultaneously carry out salting-out and fusion, it is required that salting agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.), and more preferably from (Tg plus 15° C.) to (Tg plus 40° C.). An organic solvent which is dissolved in water infinitely may be added in order to conduct the salting out/fusion effectively.

(Filtration and Washing Process)

In the filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner's funnel and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colored particles is added to the dispersion of the compound resin particles and the compound resin particles and the colored particles are salted-out and coagulated.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

The surface property of thus produced toner particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

Each of the constituting materials used in the toner producing process is described in detail below.

(5) Polymerizable Monomer

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

Hydrophobic Monomer

The hydrophobic monomer can be used, one or more kinds of which may be used for satisfying required properties.

Practically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as (meth)acrylic acid and its ester bases monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

Monomer Having an Acidic Polar Group

As the monomer having an acidic polar group, (a) an α,β-ethylenically unsaturated compound containing a carboxylic acid group (—COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) of (a) include acrylic acid, methacrylic acid, fumaric acid, maleic acid, itaconic acid, cinnamic acid, maleic acid monobutyl ester, maleic acid mono-octyl ester and their sodium salts, zinc salts, etc.

Examples of said α,β-ethylenically unsaturated compound containing the sulfonic acid group (—$SO_3H$) of (b) include sulfonated styrene and its Na salt, allylsulfo succinic acid, allylsulfo succinic acid octyl ester and their sodium salts.

Monomer Having a Basic Polar Group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrylamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

Polymerization Initiators

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (for example, ascorbic acid), which is capable of initiating the polymerization at room temperature, it is possible to carry out polymerization at room temperature or higher.

Chain Transfer Agents

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservation ability, fixing strength, anti-off-set and so on. The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapto group, a neopentyl glycol compound having mercapto group, and a pentaerythritol compound having mercapto group. Among them n-octyl-3-mercaptopropionic acid ester is preferable in view of minimizing smell at the time of thermal fixing.

Surface Active Agents

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-(-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

The resin particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc.

It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

(Coagulants)

The coagulants selected from metallic salts are preferably employed.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application, and the two or three valent metal salt is preferable because of low critical coagulation concentration (coagulation point).

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the $\zeta$ potential of the dispersion, and in addition the critical coagulation concentration may be obtained as the salt concentration which initiates a variation in the $\zeta$ potential.

The polymer particles dispersion liquid is processed by employing metal salt so as to have concentration not less than critical coagulation concentration. In this instance the metal salt is added directly or in a form of aqueous solution optionally, which is determined according to the purpose. In case that it is added in an aqueous solution the metal salt must satisfy the critical coagulation concentration including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

Colorants

The toner is obtained by salting out/fusing the composite resin particles and colored particles.

Listed as colorants which constitute the toner of the present invention may be inorganic pigments, organic pigments, and dyes. Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

The magnetite can be incorporated when the toner is employed as a magnetic toner. In this instance from 20 to 60 weight percent of the magnetite is incorporated in view of sufficient magnetic characteristics.

Various organic pigments and dyes may be employed. Specific organic pigments as well as dyes are exemplified below.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

The colorants may also be employed while subjected to surface modification. Examples of the surface modifying agents include silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyitriethoxysilane, and γ-ureidopropyltriethoxysilane.

Examples of the titanium coupling agent include those marketed with brand PLENACT TTS, 9S, 38S, 41B, 46B, 55, 138S, 238S etc., by Ajinomoto-Fine-Techno Co., Inc., A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "PLENACT AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

Releasing Agents

Toner employed in the invention is preferably prepared by fusing resin particles containing a releasing agent and colored particles in water based medium and then digesting the obtained particles whereby the releasing agent and the colorant are dispersed in resin matrix adequately to form a domain-matrix structure. The digestion is a process subjecting the fused particles to continuing agitation at a temperature of melting point of the releasing agent plus minus 20 centigrade.

Preferable examples of the releasing agent include low molecular weight polypropylene and low molecular weight polyethylene each having average molecular weight of 1,500 to 9,000, and a particularly preferable example is an ester compounds represented by General Formula (1), described below.

$$R^1—(OCO—R^2)_n \quad (1)$$

wherein n represents an integer of 1 to 4, and preferably 2 to 4, more preferably 3 or 4, and in particular preferably 4, $R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

The representative examples are listed.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6)

$$CH_3-(CH_2)_{20}-COO-(CH_2)_2-\overset{\overset{CH_3}{|}}{CH}-CH_2-O-CO-(CH_2)_{20}-CH_3$$

7)

$$CH_3-(CH_2)_{22}-COO-(CH_2)_2-\overset{\overset{CH_3}{|}}{CH}-CH_2-O-CO-(CH_2)_{22}-CH_3$$

8)

$$CH_3-(CH_2)_{22}-COO-CH_2-\underset{\underset{CH_3}{|}}{\overset{\overset{CH_3}{|}}{C}}-CH_2-O-CO-(CH_2)_{22}-CH_3$$

9)

$$CH_3-(CH_2)_{26}-COO-CH_2-\underset{\underset{CH_3}{|}}{\overset{\overset{CH_3}{|}}{C}}-CH_2-O-CO-(CH_2)_{26}-CH_3$$

10)

$$\begin{array}{l} CH_2-O-CO-(CH_2)_{26}-CH_3 \\ | \\ CH-O-CO-(CH_2)_{26}-CH_3 \\ | \\ CH_2-O-CO-(CH_2)_{26}-CH_3 \end{array}$$

11)

$$\begin{array}{l} CH_2-O-CO-(CH_2)_{22}-CH_3 \\ | \\ CH-O-CO-(CH_2)_{22}-CH_3 \\ | \\ CH_2-O-CO-(CH_2)_{22}-CH_3 \end{array}$$

12)

$$\begin{array}{l} CH_2-OH \\ | \\ CH-O-CO-(CH_2)_{26}-CH_3 \\ | \\ CH_2-O-CO-(CH_2)_{26}-CH_3 \end{array}$$

13)

$$\begin{array}{l} CH_2-OH \\ | \\ CH-O-CO-(CH_2)_{22}-CH_3 \\ | \\ CH_2-O-CO-(CH_2)_{22}-CH_3 \end{array}$$

14)

$$\begin{array}{l} CH_2-OH \\ | \\ CH-OH \\ | \\ CH_2-O-CO-(CH_2)_{26}-CH_3 \end{array}$$

15)

$$\begin{array}{l} CH_2-OH \\ | \\ CH-OH \\ | \\ CH_2-O-CO-(CH_2)_{22}-CH_3 \end{array}$$

16)

$$CH_3-(CH_2)_{26}-COO-CH_2-\underset{\underset{CH_2-O-CO-(CH_2)_{26}-CH_3}{|}}{\overset{\overset{CH_3}{|}}{C}}-CH_2-O-CO-(CH_2)_{26}-CH_3$$

17)

$$CH_3-(CH_2)_{20}-COO-CH_2-\underset{\underset{CH_2-O-CO-(CH_2)_{20}-CH_3}{|}}{\overset{\overset{CH_2CH_3}{|}}{C}}-CH_2-O-CO-(CH_2)_{20}-CH_3$$

-continued

18)

$$CH_3-(CH_2)_{26}-COO-CH_2-\underset{\underset{CH_2-O-CO-(CH_2)_{26}-CH_3}{|}}{\overset{\overset{CH_2-O-CO-(CH_2)_{26}-CH_3}{|}}{C}}-CH_2-O-CO-(CH_2)_{26}-CH_3$$

19)

$$CH_3-(CH_2)_{20}-COO-CH_2-\underset{\underset{CH_2-O-CO-(CH_2)_{20}-CH_3}{|}}{\overset{\overset{CH_2-O-CO-(CH_2)_{20}-CH_3}{|}}{C}}-CH_2-O-CO-(CH_2)_{20}-CH_3$$

20)

$$CH_3-(CH_2)_{18}-COO-CH_2-\underset{\underset{CH_2-O-CO-(CH_2)_{18}-CH_3}{|}}{\overset{\overset{CH_2-O-CO-(CH_2)_{18}-CH_3}{|}}{C}}-CH_2-O-CO-(CH_2)_{18}-CH_3$$

21)

$$CH_3-(CH_2)_{16}-COO-CH_2-\underset{\underset{CH_2-O-CO-(CH_2)_{16}-CH_3}{|}}{\overset{\overset{CH_2-O-CO-(CH_2)_{16}-CH_3}{|}}{C}}-CH_2-O-CO-(CH_2)_{16}-CH_3$$

22)

$$CH_3-(CH_2)_{20}-COO-CH_2-\underset{\underset{CH_2-O-CO-CH_3}{|}}{\overset{\overset{CH_2-O-CO-CH_3}{|}}{C}}-CH_2-O-CO-CH_3$$

The releasing agent is added in an amount of between 2 and 20 percent by weight, and is preferably between 3 and 15 percent by weight.

The releasing agent is preferably incorporated in the toner particles by salting-out/fusing a colorant and resin particles involving the releasing agent prepared by mini-emulsion method.

Addition Process of External Additives

External additives are added to the dried toner particles. Examples of the additive include metal salt of aliphatic acid, external abrasive, usual additives such as silica fine powder. Examples of the preparation apparatus include Henschel mixer, Nauter mixer. It is preferable to add inorganic particles having primary diameter of 10 to 300 nm in this process.

Developer and Developing Method

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. The toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 $\mu$m, and is more preferably 25 to 80 $\mu$m.

The volume average particle diameter of said carrier can be generally determined employing a laser diffraction type particle diameter distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

Employed as development methods may be either a contact method or a non-contact method. When the non-contact development method is employed, it is possible to carry out normal development under non-contact as well as reversal development under non-contact. In such a case, a direct current development electric field is commonly from $1\times10^3$ to $1\times10^5$ V/cm in terms of the absolute value, and is preferably from $5\times10^3$ to $1\times10^4$ V/cm.

Voltage of alternate bias is 0.5–4 kVp-p, and preferably 1–3 kVp-p, and frequency is 0.1–10 kHz, and preferably 2–8 kHz.

Image Forming Method and Apparatus

The image forming apparatus employed in the image forming method using the toner of the invention is described.

Figure 2:
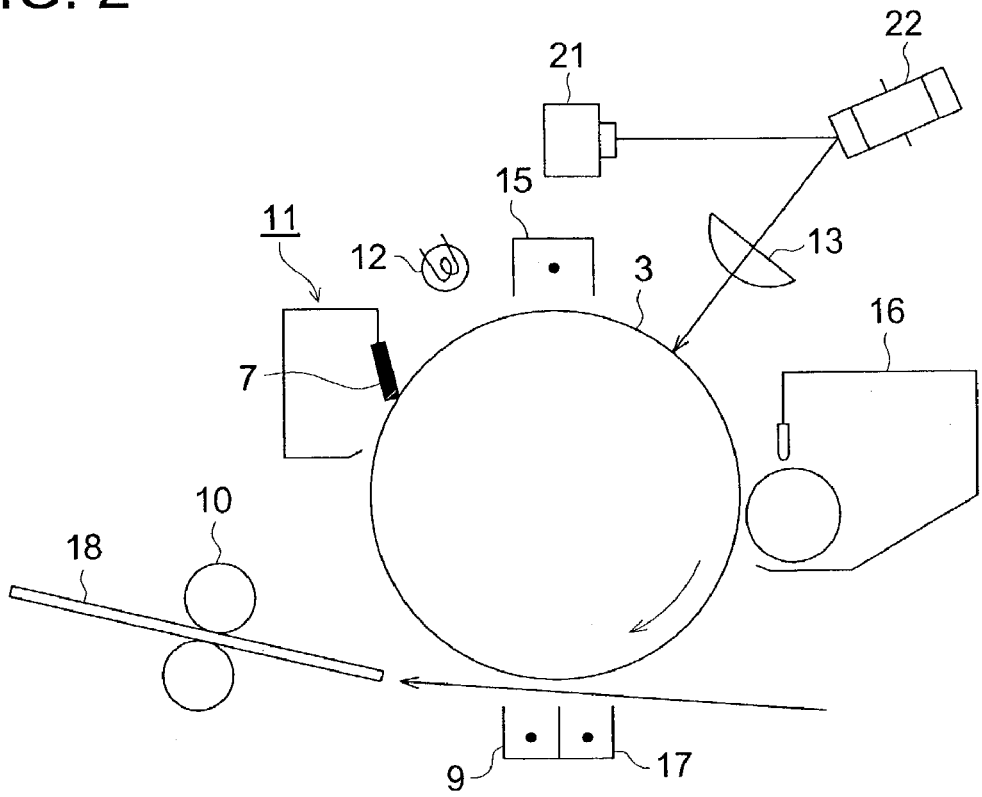
FIG. 2 shows a sectional view of schematic view of image forming apparatus.

A cross-section of a color forming apparatus is shown in FIG. 2 as an example of the color forming apparatus for describing the image forming method according to the invention.

In FIG. 2, numeral 3 shows a photoreceptor drum as a latent image carrier, which is constituted by coating OPC or organic photosensitive substance, on a substrate drum. The photoreceptor drum is grounded and driven so as to be clockwise rotated as is shown in the drawing.

Light exposure is emitted from laser diode source 21 according to the image information read in by reading means, not shown in FIG. 2. The light is scanned in a direction perpendicular to the paper plain by a rotating polygon mirror 22, and is exposed to the photoreceptor to form a latent image through an fθ lens 13, which compensate distortion of image. The photoreceptor drum 3 is charged uniformly by a charger 15 previously and starts rotation synchronized with the timing of the image exposure.

Developing device 16 develops the latent image on the photoreceptor, and the developed image is transferred to synchronously driven transferee paper 18 by transfer device 17. The transferee paper is separated from the photoreceptor by separating device (separating pole) 9, and the transferred image on the transferee paper is carried to fixing device to be fixed.

Remaining toner particles on the photoreceptor are swept by cleaning device 11. The residual charge on the photoreceptor is cancelled through precharging exposure light 12, and charger 15 again charges the photoreceptor uniformly.

Further, said image forming apparatus may be structured so that a processing cartridge can be installed which comprises at least one of a photoreceptor drum, a charging unit, a development unit, a cleaning unit, or a recycling member.

Representative transfer paper includes plain paper. However, it is not particularly limited as long as unfixed images after development can be transferred, and includes a PET base for OHP.

In recent years, in the electrophotographic field wherein electrostatic latent images are formed on a photoreceptor and the resultant latent images are developed to prepare visible images, increasingly carried out has been research and development of the image forming method utilizing a digital system which makes it possible to easily carry out improvement in image quality, transformation, and edition, and to form high quality images.

As computers which are employed in said image forming method and apparatus thereof, or an optical scanning system which carries out light modulation based on digital image signals from copying original documents, included are a unit in which an acoustic optical modulator is provided via an optical laser system and light modulation is carried out employing said acoustic optical modulator, as well as a unit in which a semiconductor laser is employed and laser intensity is subjected to direct modulation. Spot exposure is carried out onto a uniformly charged photoreceptor from said optical scanning system whereby dot images are formed.

A beam irradiated from said optical scanning system results in a circular or elliptical luminance distribution near the normal distribution having a wide range at both sides. For example, a laser beam in either the primary direction or the secondary direction, or in both directions on the photoreceptor, generally results in extremely narrow circles or ellipses of 20 to 100 $\mu$m.

Cleaning Means and Other Structures

It is preferable that cleaning is carried out employing a blade cleaning system which employs elastic rubber blades as a member. Employed as elastic rubber may be urethane rubber and silicone rubber. Of these, urethane rubber is particularly preferred.

When employed as printers of facsimile machines, image exposure unit performs exposure to print receiving data.

It is possible to apply the image forming apparatus of the present invention to general electrophotographic apparatuses such as copiers, laser printers, LED printers, and liquid crystal shutter type printers. It is also possible to apply the same widely to displays, recording, shortrun printing, plate making, and facsimiles to which electrophotographic techniques are applied.

EXAMPLES

The present inventing will now be detailed with reference to examples.

Preparation Example of Colored Particles

Preparation of Colored Particles 1 (Example of Emulsion Polymerization)

1. Preparation of Latex 1

The First Step of Polymerization (Preparation of Core Particle, Mw=138,000)

In a 5,000 ml separable flask with a stirrer, a thermal sensor, a cooler and a nitrogen supplying apparatus, a surfactant solution composed of 3,040 g of ion-exchanged water and, dissolved therein, 4.0 g of anionic surfactant (101), $C_{10}H_{21}(OCH_2CH_2)_2OSO_3Na$, was charged as an aqueous medium. The temperature of the content was raised up to 80° C. while stirring at 230 rpm under a nitrogen gas stream.

Into the surfactant solution, an initiator solution composed of 10 g of polymerization initiator, potassium persulfate KPS, dissolved in 400 g of ion exchanged water and the temperature of the content was adjusted to 75° C. Then a monomer mixture liquid composed of 560 g of styrene, and 200 g of n-butyl acrylate, 40 g of methacrylic acid was dropped into the solution spending 1 hour. This system was heated and stirred for 2 hours for carrying out polymerization. (The first step polymerization). Thus latex, a dispersion of resin particle was prepared. The latex was referred to as Latex 1H.

The Second Step of Polymerization (Formation of Interlayer Mw=80,000)

In a flask with a stirrer, 77 g of Exemplified Compound 19 was added as a releasing agent to a monomer mixture solution composed of 95 g of styrene, 36 g of n-butyl acrylate, 9 g of methacrylic acid and 0.59 g of n-octyl-3-mercaptopropionic acid ester. The content was heated at 90 C for dissolving the releasing agent. Thus, Monomer Solution was prepared.

Besides, a surfactant solution composed of 1560 ml of ion exchanged water and, dissolved therein, 1.0 g of the foregoing anionic Surfactant 101 was heated by 98° C. and 28 g in terms of the solid ingredient of the dispersion of the core particle Latex 1H was added to the surfactant solution. Then the foregoing Monomer Solution was mixed into the surfactant solution containing Latex 1H by a mechanical dispersing machine CLEARMIX having a circulation channel, manufactured by M-Technique Co., Ltd., and dispersed for 8 hours to prepare an emulsion which contains emulsified particles (oil drops) having an average particle size of 284 nm.

Then, an initiator solution composed of 200 ml of ion-exchanged water and, dissolved therein, 5 g of the polymerization initiator KPS was added to the emulsion. This system was heated and stirred at 98° C. for 12 hours for carrying out polymerization, the second step of polymerization. This latex was referred to as Latex 1HM. The third step of polymerization (Formation of outer layer, Mw=170,000)

To the foregoing Latex 1HM, an initiator solution composed of 265 ml of ion-exchanged water and, dissolved therein, 6.8 g of the polymerization initiator KPS was added and a monomer mixture of 249 g of styrene, 88.2 g of n-butyl acrylate, 19.4 g of methacrylic acid, and 7.45 g of n-octyl-3-mercaptopropionic acid ester was dropped over 1 hour.

After the dropping, polymerization, the third step of polymerization was carried out by heating and stirring for 2 hours. Then the reaction liquid was cooled by 28° C. Thus latex was prepared. This latex was referred to as Latex 1HML.

The composite resin particle of Latex 1 HML has peaks at molecular weight of 138,000, 80,000 and 17,000, and a weight average particle diameter was 122 nm.

2. Preparation of Latex 2 (Preparation of Shell Material, Mw=110,000)

In a flask with a stirrer, initiator solution containing 14.8 g of KPS dissolved in 400 ml of water was added. A monomer mixture solution composed of 600 g of styrene, 190 g of n-butyl acrylate, 30.0 g of methacrylic acid and 20.8 g of n-octyl-3-mercaptopropionic acid ester was added to the initiator solution containing at 80° C. over 1 hour. After the dropping, polymerization, polymerization was carried out by heating and stirring for 2 hours. Then the reaction liquid was cooled by 28° C. Thus latex, a dispersion containing resin particles of low molecular weight resin) was prepared. This latex was referred to as Latex 2L.

The composite resin particle of Latex 1 has a peak molecular weight at 11,000, and a weight average particle diameter was 122 nm.

3. Preparation of Colorant Dispersion

In 1,600 ml of ion-exchanged water, 90 g of anionic Surfactant (101) was dissolved by stirring. To the solution, 420.0 g of C.I. Pigment Blue 15:3 was gradually added and dispersed by CLEARMIX, manufactured by M-Technique Co., Ltd., to prepare a dispersion of the colorant particles. The dispersion of the colorant was referred to as Colorant Dispersion 1.

The weight average diameter of the colorant particle in Colorant Dispersion 1 was 110 nm according to the measurement by electrophoresis light scattering photometer ELS-800, manufactured by OTSUKA ELECTRONICS CO., LTD.

4. Preparation of Particles by Coagulation/Fusion Association

In a four mouth flask as the reaction vessel to which a thermal sensor, cooler, nitrogen conduction apparatus and stirrer were attached, 420.7 g in terms of solid component of each of Latex 1HML, 900 g of ion-exchanged water 200 g of Magenta Colorant Dispersion were charged and stirred.

The content was heated by 30° C. and the pH of the liquid was adjusted to 8 to 11.0 by the addition of a sodium hydroxide solution having a concentration of 5 moles/liter.

Subsequently, an aqueous solution prepared by dissolving 10 g of magnesium chloride heptahydrate in 1,000 ml of deionized water was added at 30° C. over 10 minutes. After setting the resulting mixture aside for 3 minutes, it was heated so that the temperature was increased to 90° C. over 30 minutes to make the particle diameter grown by coagulation.

While maintaining the resulting state, the diameter of coalesced particles was measured employing a "SLAD 2000", with 50 μm orifice. When the number average particle diameter reached 4.0 μm, the growth of particles was terminated by the addition of an aqueous solution prepared by dissolving 40.2 g of sodium chloride in 1,000 ml of deionized water, and further fusion was continually carried out at a liquid media temperature of 98° C. for 2 hours, while being heated and stirred.

5. Shell forming and Fine Particles Generation

Further, temperature was adjusted at 85° C. and then 120 g of Latex 2 (Dispersion of resin particles) was added, and it is subjected to heating and stirring for 2 hours so that a part of particles of Latex 2L was fused onto surface of coagulated particles of Latex 1HML and other particles of Latex 2L remained in the dispersion. Particle distribution was observed and confirmed it has a peak at 1.2 μm with a ratio of particles of 0.4%.

To the resulting dispersion 40.2 g of sodium chloride was added and the dispersion was cooled to 30° C. at rate of 8° C./min, then the pH of the liquid was adjusted to 2.0 by addition of hydrochloric acid, and stirring was terminated. Particles were filtrated and washed with ionized water repeatedly, then dried with air at 40° C. to obtain Colored Particles 1.

Preparation of Colored Particles 2

Colored Particles 2 was prepares in the same way as Colored Particles 1 except that the stirring time in the shell forming process was modified to 4 hours.

Preparation of Colored Particles 3

Colored Particles 3 was prepares in the same way as Colored Particles 1 except that the stirring time in the shell forming process was modified to 1 hour.

Preparation of Colored Particles 4

Colored Particles 4 was prepares in the same way as Colored Particles 1 except that the number average particle diameter was adjusted to 3.2 μm in the Coagulation/Fusion Association.

Preparation of Colored Particles 5

Colored Particles 5 was prepares in the same way as Colored Particles 1 except that an amount of magnesium chloride heptahydrate was modified to 12.5 g, and the number average particle diameter was adjusted to 4.9 μm in the Coagulation/Fusion Association.

Preparation of Colored Particles 6

Colored Particles 6 was prepares in the same way as Colored Particles 1 except that time for heating and stirring was modified to 3 hours in place of 6 hours in the Coagulation/Fusion Association.

Preparation of Comparative Colored Particles 1

Comparative Colored Particles 1 was prepares in the same way as Colored Particles 1 except that an amount of magnesium chloride heptahydrate was modified to 15 g, an amount of Latex 2L was modified to 60 g, and time for heating and stirring was modified to 4 hours in place of 6 hours in the Coagulation/Fusion Association.

Preparation of Comparative Colored Particles 2

Comparative Colored Particles 2 was prepares in the same way as Colored Particles 1 except that an amount of magnesium chloride heptahydrate was modified to 14 g.

Preparation of Comparative Colored Particles 3

Comparative Colored Particles 3 was prepares in the same way as Colored Particles 1 except that the stirring time in the shell forming process was modified to 40 minutes.

Preparation of Toner and Developer

Added to each of said Colored Particles 1 through 6 and Comparative Colored Particles 1 through 3 was hydrophobic silica (having a hydrophobicity of 68 and a number average primary Particles diameter of 12 nm) in an amount of 0.5 percent by weight, and thus the toner examples were obtained. Resulting toners were designated as Toners 1 through 6 and Comparative Toners 1 through 3.

Silicone resin-coated ferrite carrier having a volume average Particles diameter of 60 μm was added to each of toners 1–8 and comparative toner so as to have a toner concentration of 6 percent. Resulting mixtures were designated as Developers 1 through 6, and Comparative Toners 1 through 3 corresponding to each of the cited toners.

TABLE 1

| | Number average particle diameter (μm) | Toner particle distribution: Peak or maximum value among 1–2 μm (μm) | Content of 1–2 μm particles (%) | Content of particles more than 6.35 μm (%) |
|---|---|---|---|---|
| Example 1 | 4.0 | 1.2 | 0.4 | 1.0 |
| Example 2 | 4.0 | 1.2 | 0.1 | 2.0 |
| Example 3 | 4.0 | 1.2 | 5.0 | 1.0 |
| Example 4 | 3.2 | 1.2 | 1.2 | 0.0 |
| Example 5 | 5.0 | 1.2 | 0.7 | 5.0 |
| Example 6 | 4.0 | 1.2 | 0.4 | 1.0 |
| Comparative Example 1 | 6.0 | None | 0.0 | 12.0 |
| Comparative Example 2 | 4.0 | 1.2 | 0.4 | 6.0 |
| Comparative Example 3 | 4.0 | 1.2 | 6.0 | 3.0 |

Printing Test

The printing test was conducted employing the toners by means of a digital copying machine, Konica Sitios 7075, manufactured by Konica Corporation.

Evaluation and Measurement

1. Toner Transfer Ratio

A printing image was formed continuously at 33° C. and 80% RH, wherein an toner image was formed on a photoreceptor in amount of 60 mg/cm$^2$, and the image was transferred to a paper. The transferred toner per unit area in % was measured.

A: Transfer ratio 90% ore more

B: Transfer ratio from 80% and not more than 90%

C: Transfer ratio not more than 80%

2. Cleaning Property

After printing image was formed on 5,000 sheets of paper continuously at 33° C. and 80% RH, power of the test machine was shut down and after 72 hours printing test strded again. Images obtained after rest was observed and number of white spots having diameter of 0.3 mm or more in solid image per A4 size paper was counted.

A: No spots

B: 1–4 spots

C: 5 or more spots

3. Uneven Halftone Image

Halftone image at density of 0.35 was observed by human eyes to estimate unevenness.

A: Image without unevenness

B: Image having less than 3 slight streaks

C: Image having more than 3 clear streaks

4. Fine Lines Reproduction

Line width corresponding to 2-dot line image signal was measured by a printing image evaluation system RT 2000, produced by Yahman Corporation. Variation of line width on 20,000th printed sheet was measured.

A: Line width variation less than 7 μm

B: Line width variation not more than 7 μm and less than 10 μm

C: Line width variation not less than 10 μm

In the above evaluation ranks A and B are practically acceptable.

TABLE 2

| | Toner Transfer Ratio | Cleaning Property | Uneven Halftone Image | Fine Lines Reproduction |
|---|---|---|---|---|
| Example 1 | A | A | A | A |
| Example 2 | A | B | A | A |
| Example 3 | B | A | A | A |
| Example 4 | A | A | A | A |
| Example 5 | A | A | B | B |
| Example 6 | B | B | A | A |
| Comparative example 1 | C | C | C | C |
| Comparative example 2 | C | C | C | C |
| Comparative example 3 | C | C | C | C |

The result shown in Table 2 demonstrates that the Examples 1 through 6 are practically acceptable. Comparative Examples 1 through 3 are lee advantageous than Examples 1 through 6.

The invention provides a fine particle toner for developing a static latent image by which a high quality image can be obtained with a high transferring ratio, high halftone uniformity and high fine line.

What is claimed is:

1. A toner for developing a static latent image comprising toner particles having a number based particle diameter distribution curve in which a peak or a maximum value is within the range of from 1.0 to 2.0 μm, and a ratio of particles having a particle diameter of from 1.0 to 2.0 μm is from 0.1 to
5.0% and a ratio of a particle having a diameter of not less than 6.35 μm is not more than 5.0% based on a whole number of toner particles.

2. The toner of claim 1 wherein a number average diameter of the toner particles is from 3.0 to 6.0 μm.

3. The toner of claim 2 wherein the number average diameter of the toner particles is from 3.0 to 5.0 μm.

4. The toner of claim 1 wherein the ratio of particle having a diameter of at least 6.35 μm is from 0 to 2.0% based on a whole number of toner particles.

5. The toner of claim 1 wherein the ratio of particle having a diameter of at least 6.35 μm is from 0 to 1.0% based on while number of toner particles.

6. The toner of claim 1 which further comprises inorganic particles having primary diameter of 10 to 300 nm and does not contain inorganic particles having primary diameter of 1 μm or more.

7. A method of producing the toner of claim 1, comprising dispersing the toner particles in a dispersion medium, separating the toner particles from the dispersion medium, drying the separated toner particles.

8. The method of claim 7, further comprising adding inorganic particles having primary diameter of 10 to 300 μm to the toner particles externally.

9. A method of forming a toner image, comprising:

electrically charging a photoreceptor;

imagewise exposing the photoreceptor so that a latent image is formed on the photoreceptor;

developing the latent image with toner so that a toner image is formed on the photoreceptor;

transferring the toner image to an image forming body; wherein toner of claim 1 is employed.

10. The toner of claim 1 comprising a releasing agent represented by the formula $R1(OCOR2)_n$, wherein n is an integer of 1 to 4, and R1 and R2 each represents a hydrocarbon group which may have a substituent.

11. The toner of claim 10 wherein R1 and R2 each has 1 to 40 carbon atoms.

12. The toner of claim 10 comprising the releasing agent in an amount of between 2 and 20 percent by weight.

13. The toner of claim 3 wherein the ratio of particle having a diameter of at least 6.35 μm is from 0 to 2.0% based on a whole number of toner particles, and the toner comprises a releasing agent represented by the formula $R1(OCOR2)_n$, wherein n is an integer of 1 to 4, and R1 and R2 each represents a hydrocarbon group having 1 to 40 carbon atoms.

14. The method of claim 9 wherein the developing is performed by a reversal development method under non-contact development method.

15. The method of claim 14 further comprising applying a direct current development electric field from $1\times10^3$ to $1\times10^5$ V/cm in terms of the absolute value in the developing.

16. The method of claim 15 wherein the direct current development electric field is from $5\times10^3$ to $1\times10^4$ V/cm in terms of the absolute value.

17. The method of claim 15 further comprising applying 0.5–4 kVp-p of voltage of alternate bias under a frequency of 0.1–10 kHz in the developing.

18. The method of claim 17 wherein the voltage of alternate bias is 1–3 kVp-p, and the frequency is 2–8 kHz.

19. The method of claim 7 comprising conducting a polymerization process to prepare resin particles from a monomer and conducting a coagulation/fusion-adhering process to obtain a toner particle dispersion from the resin particles.

20. The method of claim 19 wherein the coagulation/fusion-adhering process comprises shelling the agglomerated resin particle by a second resin to form a resin layer.

* * * * *